US010681946B2

(12) United States Patent
Johnston

(10) Patent No.: US 10,681,946 B2
(45) **Date of Patent: *Jun. 16, 2020**

(54) HEADBAND WITH PROTECTIVE INSERT

(71) Applicant: Shane Michael Johnston, Long Beach, CA (US)

(72) Inventor: Shane Michael Johnston, Long Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/133,136

(22) Filed: Sep. 17, 2018

(65) Prior Publication Data

US 2019/0014839 A1 Jan. 17, 2019

Related U.S. Application Data

(63) Continuation of application No. 15/093,464, filed on Apr. 7, 2016, now Pat. No. 10,080,394.

(60) Provisional application No. 62/147,437, filed on Apr. 14, 2015.

(51) Int. Cl.

| | |
|---|---|
| ***A41D 20/00*** | (2006.01) |
| ***A41D 13/05*** | (2006.01) |
| ***A42B 3/00*** | (2006.01) |
| ***A42B 1/08*** | (2006.01) |
| ***A42B 3/12*** | (2006.01) |

(52) U.S. Cl.

CPC ..... *A41D 20/00* (2013.01); *A41D 13/05* (2013.01); *A42B 1/08* (2013.01); *A42B 3/00* (2013.01); *A42B 3/127* (2013.01)

(58) Field of Classification Search

CPC .. A42B 3/00; A42B 3/06; A42B 1/041; A63B 71/10; A42C 5/02; A42C 5/04; A41D 20/00; A41D 20/005

See application file for complete search history.

(56) References Cited

U.S. PATENT DOCUMENTS

| | | | | |
|---|---|---|---|---|
| 3,900,035 | A * | 8/1975 | Welch | A61F 7/10 607/108 |
| 4,277,847 | A * | 7/1981 | Florio | A61F 9/045 2/12 |
| 4,646,367 | A | 3/1987 | El Hassen | |
| 4,698,852 | A | 10/1987 | Romero | |
| 4,910,804 | A | 3/1990 | Lidgren | |
| 4,947,488 | A | 8/1990 | Ashinoff | |
| 5,395,400 | A * | 3/1995 | Stafford | A42B 1/008 2/209 |
| 5,946,734 | A | 9/1999 | Vogan | |
| 5,963,989 | A | 10/1999 | Robertson | |
| 6,000,062 | A | 12/1999 | Trakh | |
| 6,266,826 | B1 | 7/2001 | Alfano | |

(Continued)

OTHER PUBLICATIONS

Crasche.com webpage; printed: Apr. 13, 2015.

*Primary Examiner* — Tajash D Patel

(74) *Attorney, Agent, or Firm* — Vista IP Law Group LLP

(57) ABSTRACT

A headband with one or more protective inserts. The inserts may be strategically positioned to provide protection for specific areas of a person's head that are most vulnerable to impact, depending on the sport or other activity. The inserts may be directly attached to the headband, or may be enclosed in pouches which are directly attached to the headband. The headband may be worn with or without additional headgear, and may be configured to cooperate with the additional headgear as to form, fit, and functionality.

20 Claims, 6 Drawing Sheets

(56) References Cited

U.S. PATENT DOCUMENTS

| | | | | |
|---|---|---|---|---|
| 6,349,416 | B1 | 2/2002 | Lampe et al. | |
| 6,397,399 | B1 | 6/2002 | Lampe et al. | |
| 6,427,253 | B1 | 8/2002 | Penny | |
| 6,438,761 | B1 | 8/2002 | McGarrity | |
| 6,493,881 | B1 | 12/2002 | Picotte | |
| 6,554,787 | B1 | 4/2003 | Griffin et al. | |
| 8,458,820 | B2 * | 6/2013 | Cleva | A42B 1/08 2/171 |
| 8,613,114 | B1 | 12/2013 | Olivares | |
| 8,739,316 | B1 | 6/2014 | Norton | |
| 8,789,212 | B2 | 7/2014 | Cleva | |
| 10,080,394 | B2 * | 9/2018 | Johnston | A41D 20/00 |
| 2015/0040296 | A1 * | 2/2015 | Hanson | A42B 3/069 2/411 |
| 2016/0058084 | A1 * | 3/2016 | Stevenson | A41D 20/005 2/209.13 |
| 2018/0199653 | A1 * | 7/2018 | Paige, Sr. | A42B 3/125 |

* cited by examiner

HEADBAND WITH PROTECTIVE INSERT

RELATED APPLICATIONS

The present application is a continuation of U.S. patent application Ser. No. 15/093,464, now allowed, and claims priority thereto under 35 U.S.C. § 120, and which itself claims priority to U.S. provisional patent application Ser. No. 62/147,437, filed Apr. 14, 2015, under 35 U.S.C. § 119. The contents of the aforementioned applications are hereby incorporated herein by reference in their entirety as if set forth fully herein.

FIELD OF THE INVENTION

The present invention relates generally to sporting equipment, and more particularly to protective headgear.

BACKGROUND

Protective gear exists for athletes to wear while engaged in sports or other physical activity. Of particular interest is headgear to help minimize head injuries. Safety is typically balanced against appearance and functionality. In other words, although safety is typically a primary concern in the design of protective headgear, interference with the athlete's vision and agility must also be considered. Likewise, the headgear typically should be stylish or have a pleasing appearance.

Helmets are the most common protective headgear, and thus the word "helmet" is used often herein for convenience to refer to helmets and other protective headgear. They are used in racing (e.g., bicycle, motorcycle, auto), football, baseball, hockey, kayaking, white-water rafting, skiing, mountain climbing, amateur boxing, and many other sports and activities. For these sports and activities, there is a need for a second layer of head protection that can be worn with little or no discomfort, and little or no effect on the outer headgear profile. Additionally, helmets are not used in some sports such as hiking, weightlifting, jogging, surfing, or simply working out at the gym. Even some major semi-contact sports such as soccer, basketball, and lacrosse, are played without helmets. For these non-helmet activities, there is a need for a first layer of head protection that can be worn with little or no discomfort, and a minimal profile.

Thus, a headband with protective inserts and a minimal profile for both comfort and appearance is desirable to supplement a helmet in some sports and physical activities, and provide a first layer of protection in others, to provide a measurable layer of protection to certain areas of the athlete's head.

SUMMARY

The present invention comprises a headband with one or more protective inserts. The headband may be worn alone, or under a helmet or other protective headgear. In the latter case, the headband may be detached from the other headgear, or may be attached to but detachable from the other headgear using friction gel, tape, buttons, snaps, latches, VELCRO, laces, elastic bands, or other means, or any combination thereof. In either case, the headband or portions thereof may be loosely and/or strictly aligned/mated with mating profiles on the inside of the other headgear, to snugly cooperate with the other headgear. The alignment may coincide with one or more of the protective inserts. In some embodiments, the headband may be both attached to the other headgear, and mated with profiles of the other headgear.

The one or more inserts may be strategically positioned to provide protection for specific areas of the athlete's head that are most vulnerable to impact, depending on the sport or activity. The inserts may be fixed, adjustable, removable, detachable, rotatable, combinable, replaceable, washable, cut-to-fit customized, or any combination thereof. The inserts may be made from various materials, including impact-resistant plastic (e.g., polycarbonate), KEVLAR, carbon-fiber, polyurethane, rubber, gel, foam padding, fiberglass, metal (e.g., aluminum and/or titanium), or any combination thereof. For example, an insert may be primarily a hard material, with a resilient coating of polyurethane on its inner and/or outer surfaces. The inserts may be removably attached directly to the headband by light glue, tape, VELCRO, or other suitable means, for fast placement and/or removal including "peel on" and "peel off". Alternatively, the inserts may be positioned inside of pouches which are attached directly to the headband. The inserts may even be permanently attached to the headband such as by being sewn in to the headband directly or by being enclosed in sewn closed pouches.

In embodiments with pouches, the pouches may be removably attached such as by light glue, tape, VELCRO, or other suitable means, or permanently attached such as with zippers, stitching, or other suitable means. The pouches may be open ended, or sealable such as with zippers, snaps, tab/slots, VELCRO, tape, glue, etc.

DRAWINGS

DETAILED DESCRIPTION

The present invention comprises a headband 5 with one or more protective inserts 10. The headband 5 may be made of any suitable material as is known in the art, including cotton, polyester, rayon, nylon, wool, velvet, velour, canvas, leather, neoprene, etc., and may have elasticity as is known in the art. The inserts 10 may be attached directly to the headband 5

(e.g., with tape, VELCRO, or light glue), or may be enclosed (at least partially) in pouches 15 which in turn are attached directly to the headband 5.

Pouches 15 and/or inserts 10 may be emblazoned with team logos, advertising, or other graphics or text. Pouches 15 may be permanently attached to the outer or inner surface of the headband 5 (e.g., by sewing), such that there are designated areas for receiving the inserts 10. Pouches 15 may alternatively be attached by VELCRO, tape, light glue, or other suitable means to allow for quick maintenance, replacement, repair, and even alternating use of graphics for various occasions. Likewise, in embodiments without pouches 15, the surfaces of the inserts 10 to be attached to the headband 5 may be VELCRO, tape, light glue, or other suitable means, for quick and easy attachment/removal. For example, if the outer surface of the headband 5 is primarily VELCRO, pouches 15 with mating VELCRO backings (or inserts 10 with such backings) may be precisely positioned as needed, and efficiently replaced during time-outs, on the sidelines between plays, during breaks, or even while actively sporting, such as jogging, cycling, etc. The same applies if the outer surface of the headband 5 has a substantially smooth surface for receiving tape-backed pouches 15 and/or inserts 10.

Figure 1:
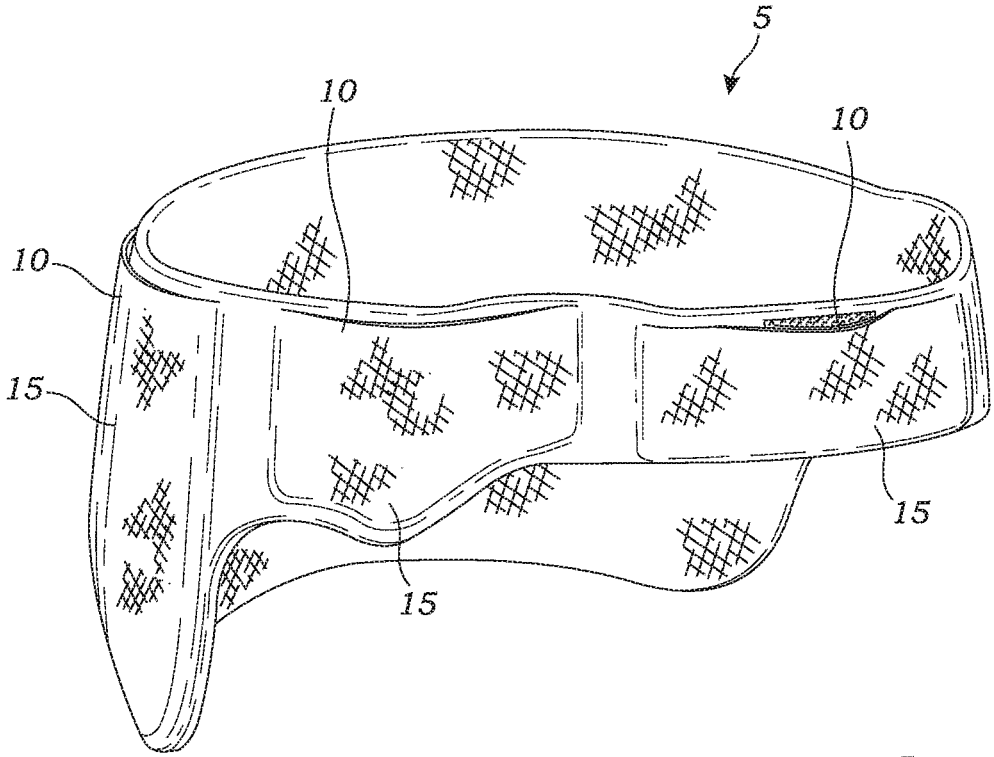
FIG. 1 is a perspective side view of a protective headband in accordance with an embodiment of the present invention.
Figure 2:
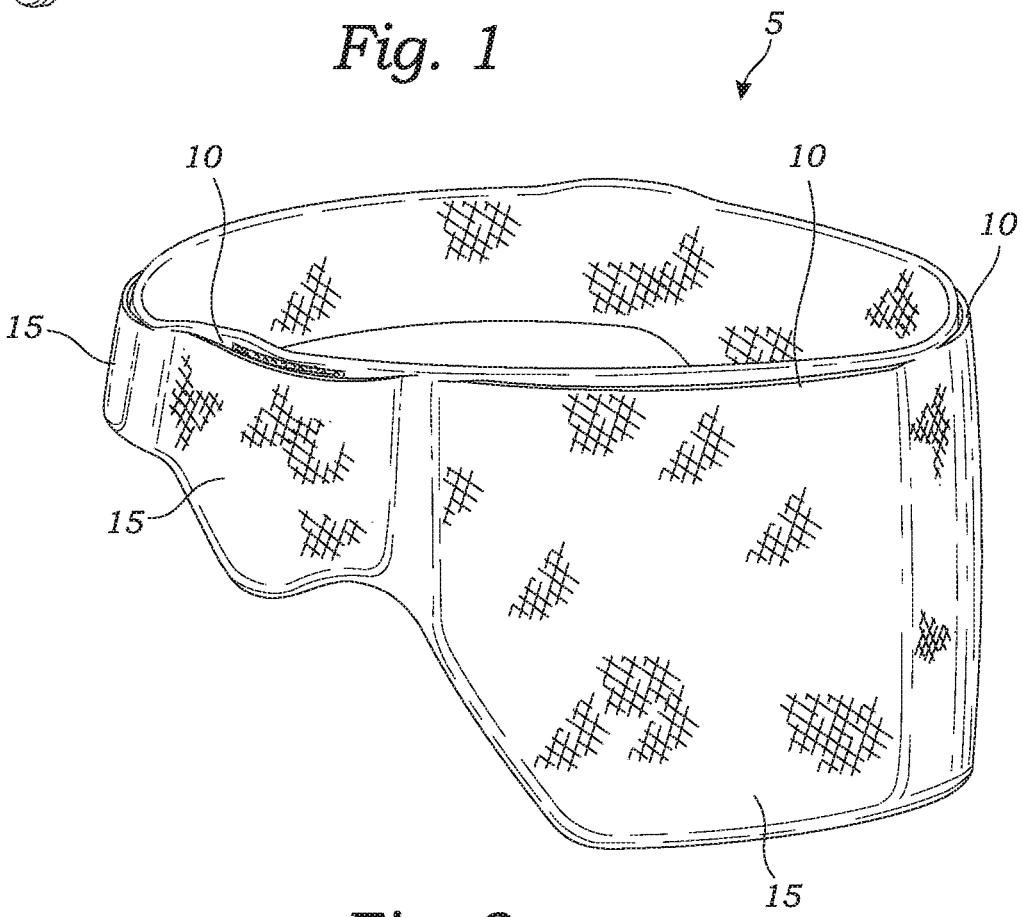
FIG. 2 is a perspective back view of the protective headband of FIG. 1.
Figure 3A:
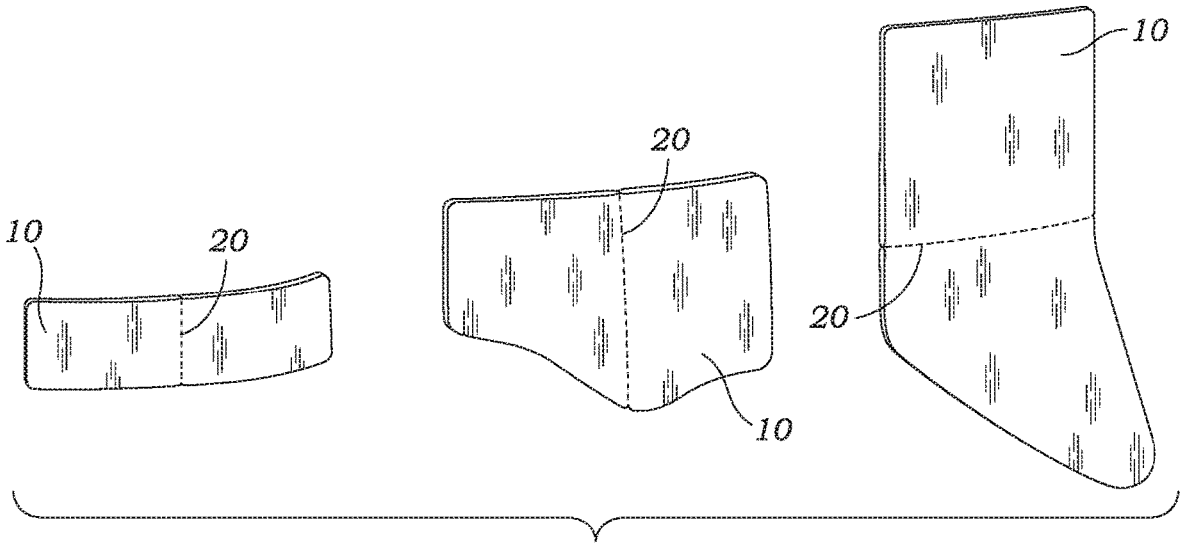
FIG. 3A is a perspective view of a first embodiment of various inserts for use with the headband of FIG. 1.

The inserts 10 are made of a hard yet flexible material, such as polypropylene, plastic, polycarbonate, polyurethane, foam padding, or any combination thereof. The material should be thick enough to absorb a measurable amount of force from impact, yet thin enough to fit securely in the headband pouches 15 and/or mating profiles 35 of a helmet 30, if applicable. Each insert 10 may be a single solid molded, stamped, or extruded piece, or for more flexibility upon impact, may be perforated at one or more locations (see, e.g., 20 in FIG. 3A), segmented, corrugated, or otherwise constructed of multiple pieces. Multiple-piece inserts 10 also allow for the option of using only a portion thereof for a particular pouch 15, depending on the comfort or other needs of the athlete.

Figure 3B:
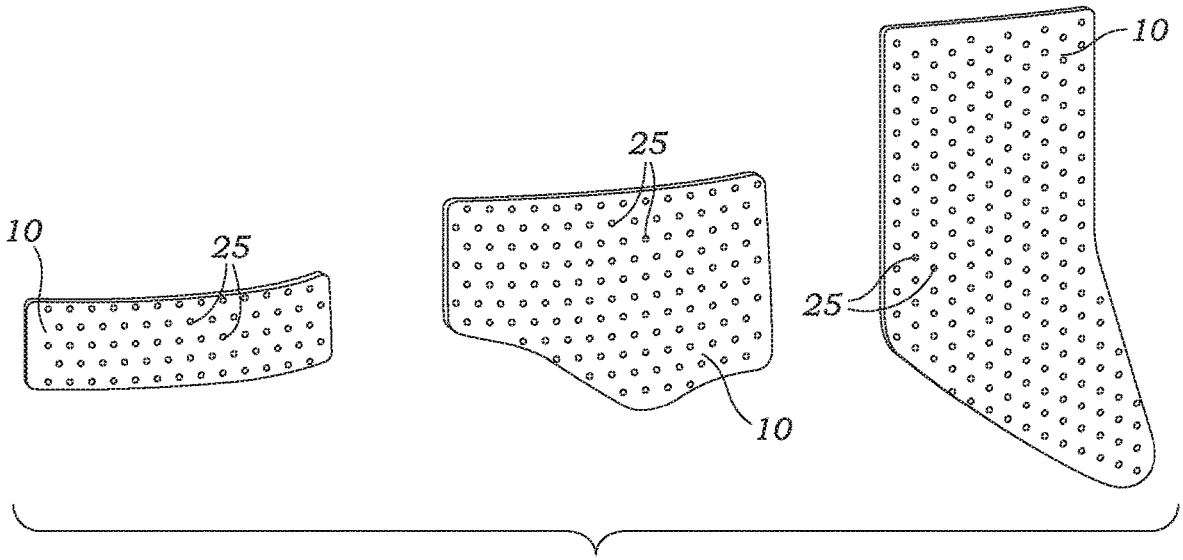
FIG. 3B is a perspective view of a second embodiment of various inserts for use with the protective headband of FIG. 1.

Each insert 10 may be uniformly thick, or may have varying thicknesses. A typical range of thickness (either uniformly or variable) is about 2 mm-8 mm, 2 mm-9 mm, or 2 mm to 10 mm, but other ranges are about 2-mm-7 mm, 2 mm-6 mm, 2 mm-5 mm, 2 mm-4 mm, 2 mm-3 mm, 3 mm-8 mm, 3 mm-7 mm, 3 mm-6 mm, and 3 mm-5 mm, 3 mm-4 mm, 4 mm-8 mm, 4 mm-7 mm, 4 mm-6 mm, and 4 mm-5 mm. The thickest portion of an insert 10 may be as thick as 10 mm or even 20 mm, especially if the insert 10 includes a padded portion. Each insert 10 may be substantially flat, or may be curved (i.e., have a degree of concavity) to substantially conform to the shape of the corresponding portion of the athlete's head against which the insert 10 will lie. Such shapes may be standard, customized for a particular athlete, and/or come in various sizes corresponding to various size headbands 5. The inserts 10 may be aerated as shown at 25 in FIG. 3B, to allow for easier evaporation of sweat. Additionally and/or alternatively, the inserts 10 may have a rough or coarse surface such as ridges, bumps, sandpaper texture, etc., as a friction element to help keep the headband 5 in place.

A preferred embodiment of the headband 5 does not cover the top of the head, i.e., like a baseball cap, helmet, or beanie hat would. This provides for better comfort (especially on hot days) and style (especially when used without a helmet). If the headband 5 has pouches 15, however, the pouches 15 should be positioned so the inserts 10 therein at least partially cover at least two of the following regions of the athlete's head when worn: the frontal; left parietal; right parietal; left sphenoidal; right sphenoidal; left temporal; right temporal; and occipital. In one embodiment, the headband 5 includes pouches 15 positioned so the inserts 10 therein at least partially cover each of the frontal, two parietal, two sphenoidal, two temporal, and occipital regions of the athlete's head.

Figure 4:
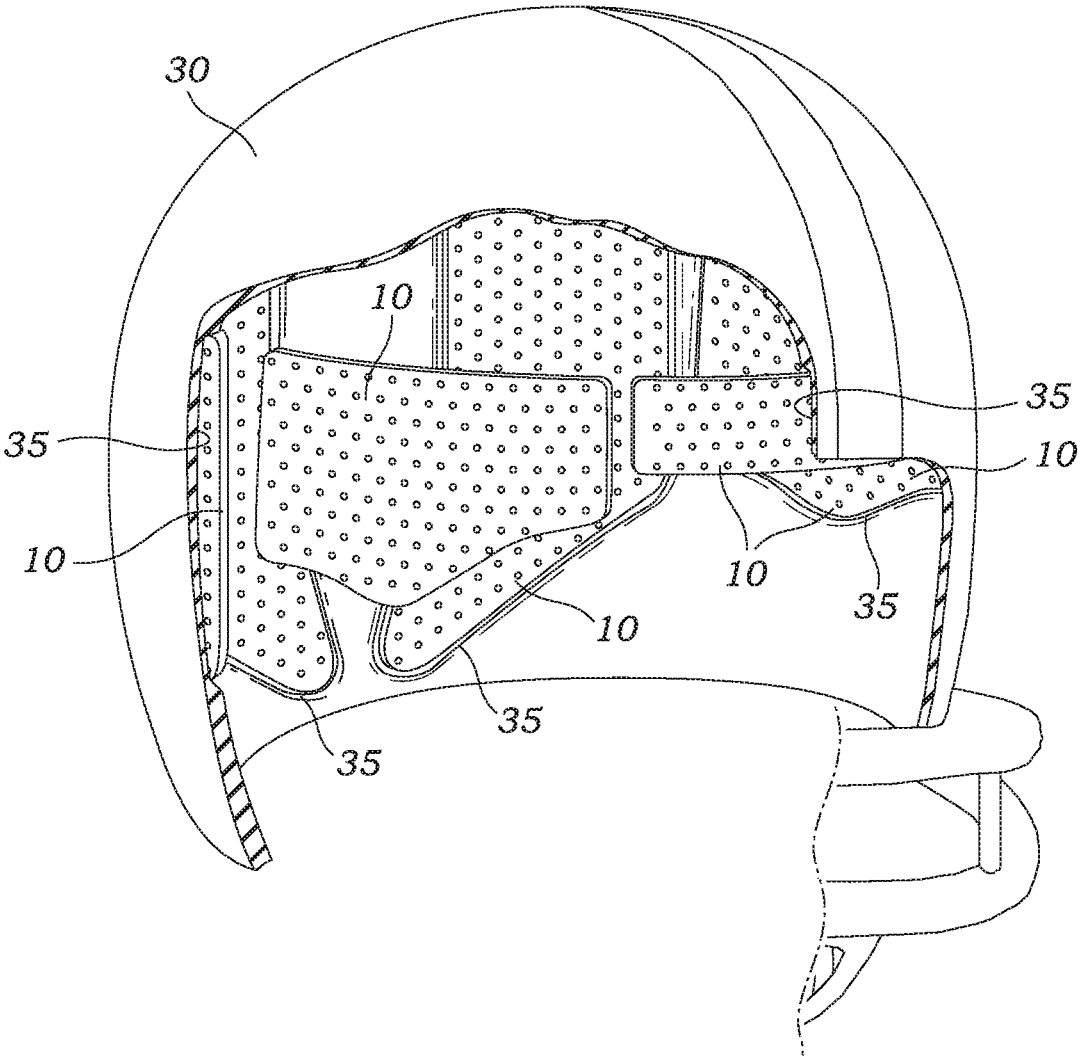
FIG. 4 is cut-away view of a helmet having cavities corresponding to locations of inserts of the protective headband of FIG. 1.
Figure 5:
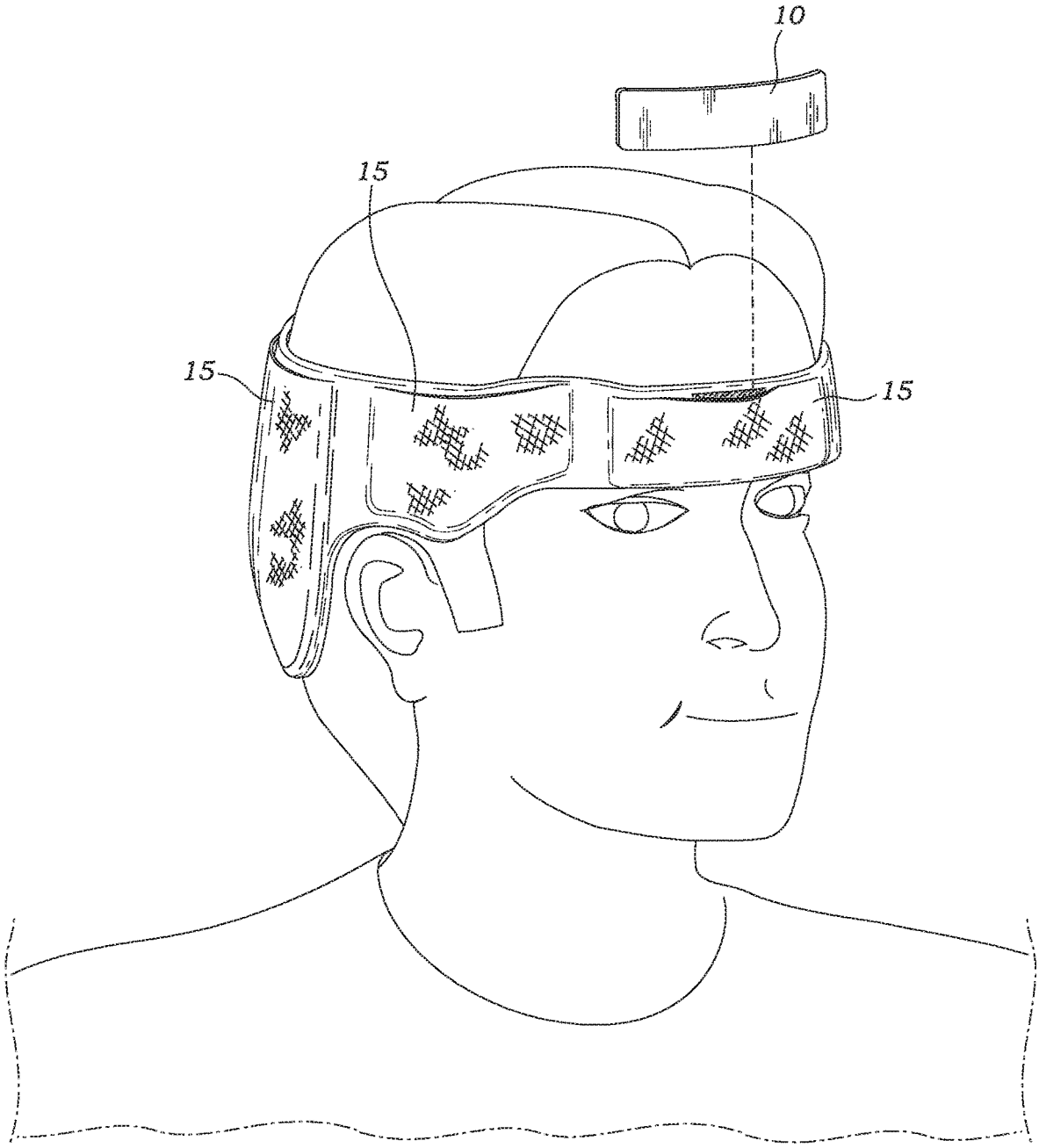
FIG. 5 is a front view of the protective headband of FIG. 1, on the head of an athlete, being worn without other protective headgear.
Figure 6:
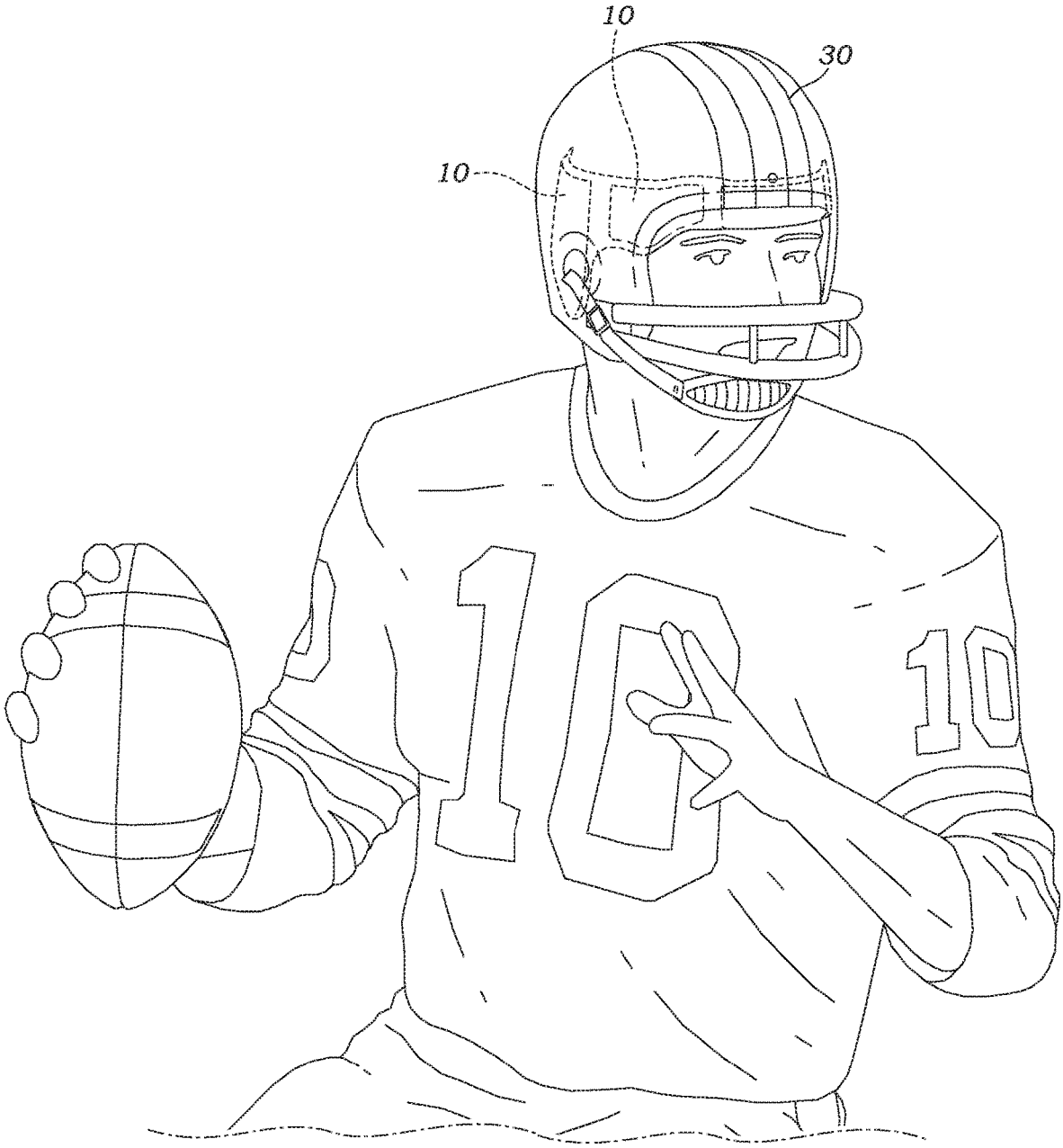
FIG. 6 is a front view of the protective headband of FIG. 1, on the head of an athlete, being worn under other protective headgear.

Typically, the headband 5 may be worn underneath a helmet 30 as seen in FIG. 6. In such instances, the athlete may opt to include only some of the inserts 10 depending on the athlete's needs. For example, an athlete may prefer to include only the occipital insert to guard against an extra vulnerable injury due to a recent injury in the same area. Or a soccer player may prefer to include only the frontal insert since most of contact with his or her head during a typical game will be at the frontal area of his or her head. In one embodiment of the present invention, the headband 5 may be attachable (and detachable) from a helmet 30, or may be attached to the helmet 30 using friction gel, tape, buttons, snaps, latches, VELCRO, laces, elastic bands, or other means, or any combination thereof. Similarly, the headband 5 or portions thereof may be aligned to mate with mating profiles 35 such as slots, recesses, cavities, indents, notches, etc., on the inside of the helmet, as seen e.g., in FIG. 4. Doing so could facilitate a snug fit with the helmet 30 without requiring the headband 5 to be physically attached to the helmet 30. Typically the alignment should coincide with one or more of the protective inserts 10. In some embodiments, the headband 5 may be both attached to the helmet 30, and mated with profiles of the helmet 30.

Figure 7:
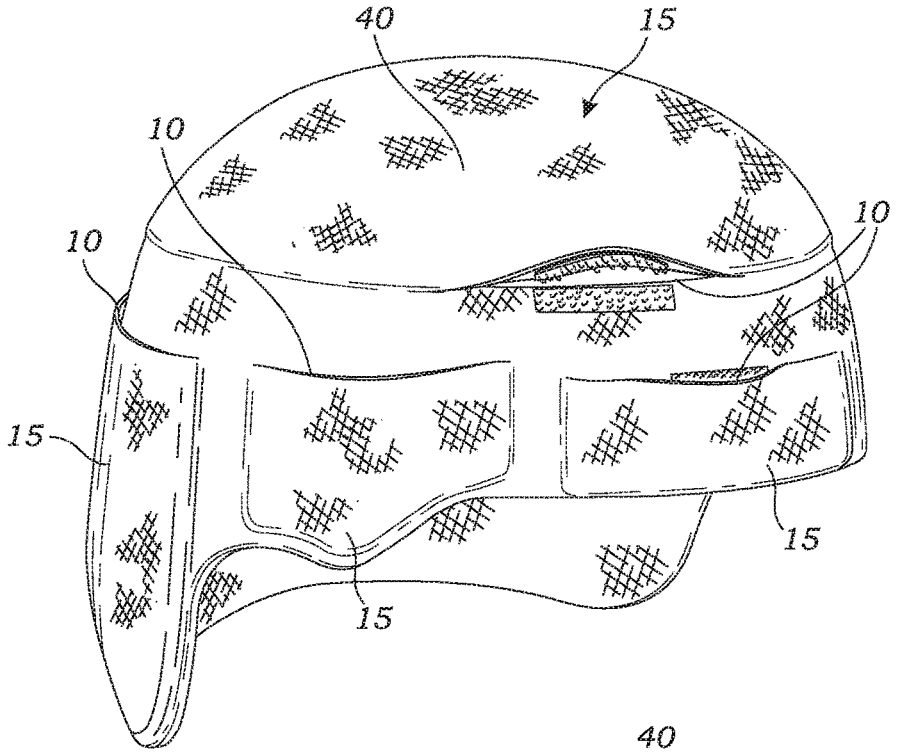
FIG. 7 is a perspective side view of a protective headband in accordance with another embodiment of the present invention.
Figure 8:
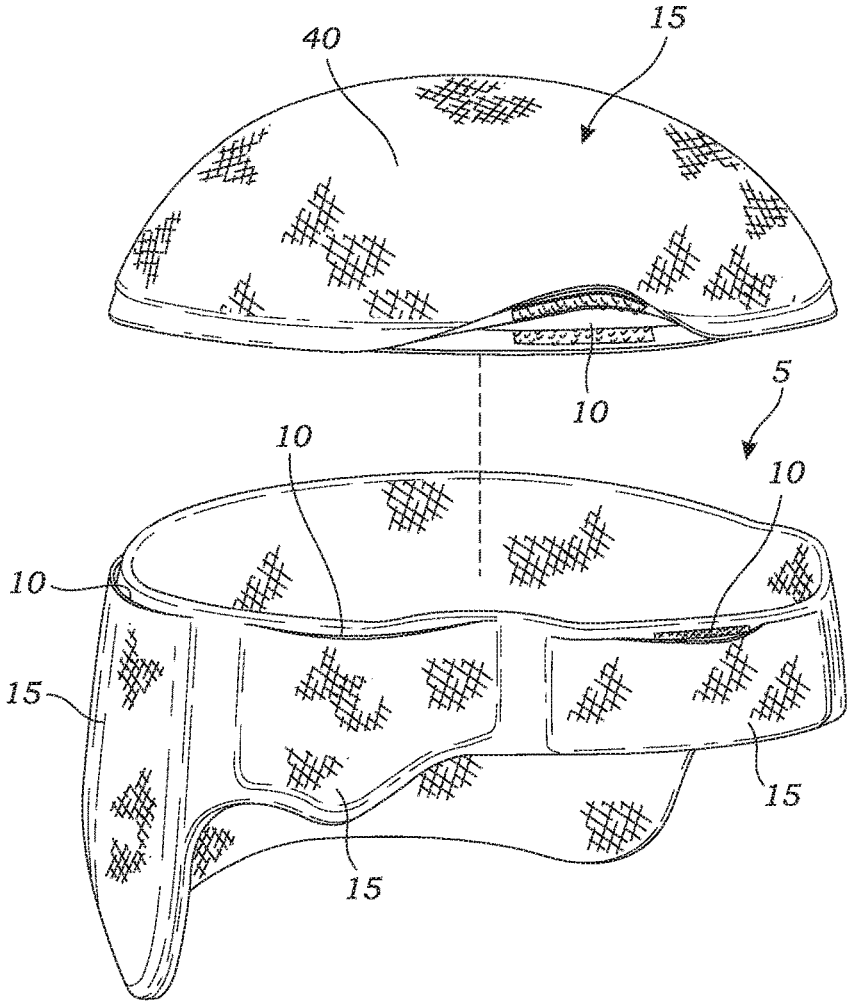
FIG. 8 is a perspective side view of a protective headband in accordance with another embodiment of the present invention.

Another embodiment of the present invention includes a headband 5 as described above, with a top portion 40 that covers the top of the head. The top portion 40 may include a protective insert 10 as well, and this insert 10 may be shaped to cover the top portion of the head. In this embodiment, the headband 5 may be one-piece or two-piece. In the one-piece embodiment as seen in FIG. 7, the headband 5 has an integrated top portion 40, either with or without a pouch or pouches 15. In the two-piece embodiment as seen in FIG. 8, the top portion 40 is separate from the rest of the headband 5 (again with or without a pouch or pouches 15), and may be attachable/detachable by buttons, snaps, VELCRO, tape, tabs/slots, glue, or any other suitable means (not shown).

Although particular embodiments of the present inventions have been shown and described, it will be understood that it is not intended to limit the present inventions to the preferred embodiments, and it will be clear to those skilled in the art that various changes and modifications may be made without departing from the spirit and scope of the present inventions. Thus, the present inventions are intended to cover alternatives, modifications, and equivalents, which may be included within the spirit and scope of the present inventions as defined by the claims.

What is claimed is:

1. A protective headgear comprising:

a headband configured to fit around a head of a person, the headband having an open top and a plurality of pouches attached to an outer surface of the headband; and a plurality of protective inserts each at least partially enclosed within the plurality of pouches respectively.

2. The protective headgear of claim 1, wherein the plurality of protective inserts comprise impact-resistant plastic.

3. The protective headgear of claim 2, wherein the plurality of protective inserts are aerated.

4. The protective headgear of claim 3, wherein each of the plurality of protective inserts are segmented.

5. The protective headgear of claim 2, wherein at least one of the pouches is detachable from the headband.

6. The protective headgear of claim 5, wherein each of the plurality of protective inserts are segmented.

7. The protective headgear of claim 1, wherein each of the plurality of protective inserts are segmented.

8. The protective headgear of claim 2, wherein each of the plurality of protective inserts are segmented.

9. The protective headgear of claim 1, wherein the plurality of protective inserts are aerated.

10. The protective headgear of claim 1, wherein the plurality of pouches includes a first pouch attached to the outer surface of the headband at a first primarily smooth location, and a second pouch attached to the outer surface of the headband at a second primarily smooth location.

11. The protective headgear of claim 10 wherein at least one of the pouches is detachable from the headband.

12. The protective headgear of claim 1, wherein at least one of the pouches is detachable from the headband.

13. The protective headgear of claim 1, wherein at least one of the protective inserts is curved to substantially fit the shape of a corresponding portion of the head of the person against which the insert will lie within the corresponding pouch when the headband is fit around the head of the person.

14. The protective headgear of claim 1, in combination with an outer headgear, wherein at least one of the protective inserts is aligned to mate with a mating profile in the outer headgear.

15. The protective headgear of claim 4, wherein the mating profile comprises a recess.

16. A protective headgear comprising:

a headband configured to fit around a head of a person, the headband having an outer surface configured to receive a detachable pouch;

a first detachable pouch attached to the outer surface of the headband at a first location, and configured to receive a protective insert; and a first protective insert at least partially enclosed within the first pouch.

17. The protective headgear of claim 16, further comprising a second detachable pouch attached to the outer surface of the headband at a second location, and configured to receive a protective insert; and a second protective insert at least partially enclosed within the second pouch.

18. The protective headgear of claim 17, wherein the outer surface of the headband is primarily smooth at the first and second locations.

19. A protective headgear comprising:

a headband configured to fit around a head of a person, the headband having an outer surface configured to receive detachable protective inserts;

a first detachable protective insert attached to the outer surface of the headband at a first location; and a second detachable protective insert attached to the outer surface of the headband at a second location.

20. The protective headgear of claim 19, wherein the first detachable protective insert and the second detachable protective insert are directly attached to the outer surface of the headband.

* * * * *